United States Patent [19]

Baker et al.

[11] Patent Number: 4,764,147

[45] Date of Patent: Aug. 16, 1988

[54] TOY FRYING PAN

[75] Inventors: David G. Baker, Elma; Craig McElhaney, East Aurora, both of N.Y.

[73] Assignee: The Quaker Oats Company, Chicago, Ill.

[21] Appl. No.: 920,859

[22] Filed: Oct. 17, 1986

[51] Int. Cl.[4] ..... A63H 33/00; A63H 5/00

[52] U.S. Cl. ..... 446/397; 446/481; 272/14

[58] Field of Search ..... 272/14; 446/236, 265, 446/397, 415, 418, 481

[56] References Cited

U.S. PATENT DOCUMENTS

| | | | |
|---|---|---|---|
| 2,047,784 | 7/1936 | Krakowski | 446/418 |
| 2,916,850 | 12/1959 | Vlachos | 446/265 |
| 3,120,717 | 2/1964 | Glass et al. | 446/481 |
| 3,120,718 | 2/1964 | Glass et al. | 272/14 |
| 3,286,396 | 11/1966 | Ryan | 446/397 |
| 3,437,338 | 4/1969 | Glass et al. | 446/418 |
| 3,765,120 | 10/1973 | Waak | 446/481 |
| 3,774,338 | 11/1973 | Waak | 446/481 |
| 4,383,386 | 5/1983 | Giordano et al. | 446/481 |

*Primary Examiner*—Robert A. Hafer
*Assistant Examiner*—Michael Brown
*Attorney, Agent, or Firm*—Cumpston & Shaw

[57] ABSTRACT

A toy frying pan is disclosed for simulating a real frying pan in the process of frying bacon or the like. The frying pan has a noise maker comprising a roughened surface formed by outwardly extending filaments or the like on a movable member in rubbing engagement with fixed flexible fins on a fixed member.

3 Claims, 1 Drawing Sheet

TOY FRYING PAN

BACKGROUND OF THE INVENTION

1. Field of the Invention

This invention relates generally to toys, and more specifically to a toy frying pan for simulating a real frying pan in the process of frying bacon or the like.

2. Description of the Prior Art

Toy frying pans comprising unitary members that look like real frying pans but are considerably smaller, are well known in the art. Although such toy frying pans look like real frying pans, none are known to produce a noise that sounds like a real frying pan in the process of frying bacon or other foods. This problem has been solved by the frying pan of this invention which is provided with a noise maker comprising a roughened surface on a movable member for rubbing against free ends of a plurality of flexible filaments on a fixed member.

SUMMARY OF THE INVENTION

An object of the present invention is to provide a toy frying pan for simulating a real frying pan in the process of frying bacon or the like comprising:

a support member;

motor means mounted on the support member;

a driven member coupled to the motor means and mounted for movement on the support member; and a noise making means interposed between the driven member and the support member for making a noise simulating frying bacon when the driven member is driven by the motor means.

In a more specific object of the invention, the noise making means comprises a roughened material, such as Velcro R material or the like, affixed to the undersurface of a driven member, and upstanding flexible filaments mounted on the support member with the free ends thereof in rubbing engagement with the roughened material.

A primary advantage of the present invention is to provide a toy frying pan that more closely simulates a real frying pan heretofore known.

The invention and its advantages will become more apparent from the detailed description of the invention presented below.

BRIEF DESCRIPTION OF THE DRAWINGS

In the detailed description of the invention presented below, reference is made to the accompanying drawings in which.

DETAILED DESCRIPTION OF THE INVENTION

Figures 1, 2, 3:
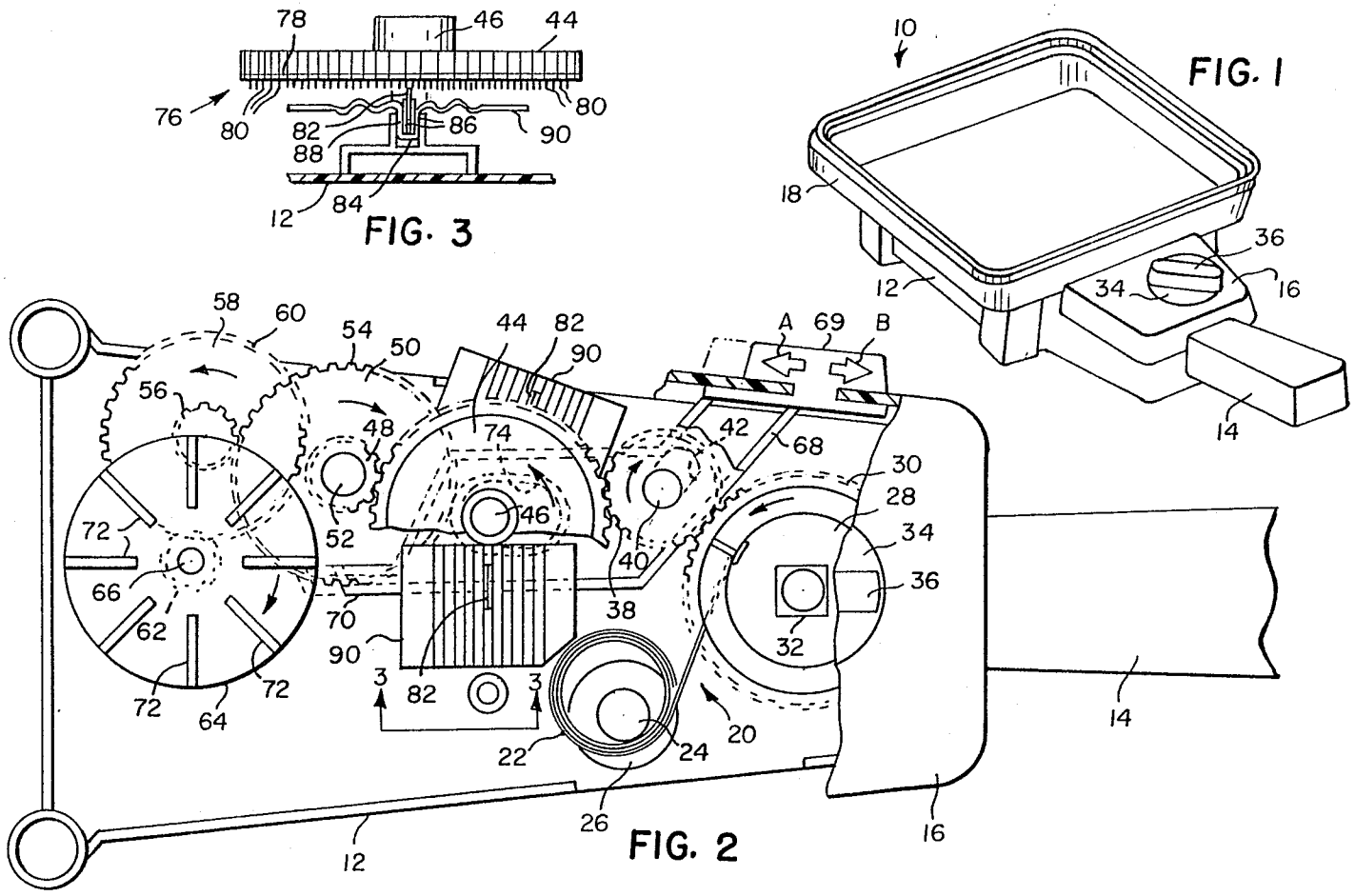
FIG. 1 is a perspective view of a preferred embodiment of the toy frying pan of this invention.
FIG. 2 is an enlarged top plan view of the frying pan with portions thereof broken away for purposes of clarity.
FIG. 3 is a section view taken substantially from line 3—3 of FIG. 2.

Referring now to FIG. 1 of the drawings, a preferred embodiment of a toy frying pan 10 of this invention comprises a base member 12 formed from any suitable plastic material. The base member has a handle 14 integral therewith and a cover member 16 mounted on base member 12 including a pan 18 which can be provided with a cover, not shown. The base member 12 and cover member 16, simulate a real frying pan which can be manually handled in make-believe fashion by its handle.

The mechanism for simulating a real frying pan in the process of frying bacon or the like is mounted on base member 12 and housed within the cavity defined by the base member and cover member 16. The mechanism comprises motor means, such as a negator spring motor 20 of a known type in which the coiled spring convolutions 22 loosely surround a post and rest on a shoulder 26 of a boss. A free end of negator spring 20 is secured to a spool portion 28 of a gear member 30 driven by the spring motor, when released. The gear member 30 has a drive hub of 32 square configuration for receiving a blind bore of comparable or complementary shape on an actuatable wind member 34 having a finger gripping handle 36. When the handle and wind member are rotated in a winding direction, the negator spring motor 20 is tensioned to drive a gear train to be described hereinafter.

The gear train that is driven by the negator spring motor, in addition to gear member 30, comprises a pinion gear 38 having a stub shaft 40 that is mountable within an arcuate slot 42. The pinion gear 38 is in meshing engagement with gear member 30, and also with a driven gear 44 mounted for rotation on a post 46 on base support member 12. The driven gear 44 is in meshing engagement with a small gear 48 of an idling double gear 50 rotatably mounted on a post 52 on the base member. The large gear 54 of double gear 50 drives a small gear 56 of another double gear 58, also rotatably mounted on a post on the base member. The large gear 60 of double gear 58 drives a small gear 62 on a speed control member 64 in the form of a vaned impeller, also rotatably mounted on a post 66 on base member 12. Accordingly, when gear member 30 is driven in a counter-clockwise direction (indicated by an arrow in FIG. 2) by negator spring motor 20, such movement forces pinion gear 38 into driving engagement with gear 44, imparting rotation to the speed controlling impeller 64 through the intermediate gears 48, 54, 56 and 60. When winding handle 36 is moved in a clockwise direction to wind up negator spring motor 20, pinion 38 is moved in its slot 42 in a direction disengaging the pinion from the gear 44.

The motor 20 is provided with a slidable lock means (FIG. 2) in the form of a shallow pan-shaped slider 68 movable by a switch button 69 in the direction of arrow A for releasably locking the spring motor in its tensioned or wound condition. The slider locking is achieved by the free end 70 of the slider which is moved into the space between adjacent vanes 72 to form a stop member in which the vanes and free end at the end of the gear train are not subjected to a large torque. The slider also has a slot 74 through which post 46 extens for guiding the slider and rigidifying the free end 70 to prevent lateral movement thereof. The spring motor 20 is released for driving the gear train by moving switch button 69 and slider 68 in the direction of arrow B thereby withdrawing the free end of the slider clear of the vanes. Since a wound negator spring 20 provides a relatively constant torque for a long period of time, the illustion of frying bacon and eggs, for example, appears to be more real than ever.

With reference to FIGS. 2 and 3, the noise making means for making a noise simulating the noise made by a real frying pan while frying bacon or the like will now be described. The noise making means comprises a roughened material or surface 76 on the undersurface of driven gear 44 preferably formed by securing a roughened material 76 by adhesive or the like to the lower surface of gear 44. The roughened material preferably comprises a support member 78 of suitable fabric or plastic material to which is secured upstanding needle-like filaments 80 of a suitable material, such as plastic. A material that works satisfactorily is the commercially available material sold under the trademark Velcro R. The free ends of the flexible filaments 80 of the roughened material 76 are in rubbing engagement with the free ends of a flexible fin 82 which is supported within a groove 84 in base member 12. The fin 82 is preferably formed from a plastic sheet-like material having a plurality of upstanding spaced-apart filaments. The fin is securable within groove 84 in the base member by any suitable means, such as nesting the fin 82 along with any needed shims 86, within a U-shaped pocket 88 formed by a sheet 90, the pocket in turn being pressed into the groove. Accordingly, when negator spring motor 20 is wound by turning wind handle 36 in a clockwise direction and then released, the roughened material 76 on the rotating driven gear 44 rubs on the fixed filaments 80 producing a sound that simulates the sizzling sound produced by a real frying pan when frying bacon or the like. Although the roughened material 76 is secured to the driving gear 44, it could just as well be secured to any moving member of the gear train, such as gear member 30, for example.

While a preferred embodiment of the invention has been shown and described with particularity, it will be appreciated that various changes and modifications may suggest themselves to one having ordinary skill in the art upon being apprised of this invention. It is intended to encompass all such changes and modifications as fall within the scope and spirit of the appended claims.

What is claimed is:

1. A toy frying pan for simulating a real frying pan in the process of frying bacon of the like comprising:

a support member;

motor means mounted on the support member;

a driven gear coupled to the motor means and mounted for movement on the support member; and a noise making means comprising a base layer secured to the driven gear having a multiplicity of outwardly extending flexible filaments and a plurality of upstanding flexible filaments mounted on the support member with the free ends thereof in rubbing engagement with the flexible filaments on the driven gear for making a noise simulating frying bacon when the driven gear is driven by the motor means.

2. A toy frying pan according to claim 1 further comprising a speed controlling means driven by the driven gear train.

3. A toy frying pan according to claim 2 wherein the speed controlling means comprises a circular vaned impellar.

* * * * *